United States Patent [19]

Wirth et al.

[11] Patent Number: 4,548,521

[45] Date of Patent: Oct. 22, 1985

[54] DOT MATRIX PRINT HEAD

[75] Inventors: Robert L. Wirth, Ithaca; Hillis L. Wilson, Groton, both of N.Y.

[73] Assignee: NCR Corporation, Dayton, Ohio

[21] Appl. No.: 559,993

[22] Filed: Dec. 9, 1983

[51] Int. Cl.[4] ..... B41J 3/12

[52] U.S. Cl. ..... 400/124; 101/93.05

[58] Field of Search ..... 400/124; 101/93.05; 335/270, 274

[56] References Cited

U.S. PATENT DOCUMENTS 4,209,260 6/1980 Jung ..... 400/124 X
4,230,038 10/1980 Hebert ..... 101/93.05
4,367,962 1/1983 Gaboardi ..... 400/124
4,407,591 10/1983 Adamoli et al. ..... 400/124
4,423,969 1/1984 Kobryn ..... 400/124

*Primary Examiner*—Paul T. Sewell
*Attorney, Agent, or Firm*—Wilbert Hawk, Jr.; George J. Muckenthaler

[57] ABSTRACT

A dot matrix print head has a unitary member in the manner of a ring with a plurality of integral projections formed to position the armatures of print wire actuators, and ring portions to space the forward and rearward assembly of parts of the print head. An annular resilient member provides means for retaining the print wire actuators in one position.

20 Claims, 13 Drawing Figures

DOT MATRIX PRINT HEAD

CROSS-REFERENCE TO RELATED APPLICATIONS

Dot Matrix Print Head Solenoid Assembly, copending application Ser. No. 470,011, filed Feb. 25, 1983 now U.S. Pat. No. 4,484,170, issued Nov. 20, 1984, invented by Robert L. Wirth, David E. Weeks and John W. Reece, and assigned to NCR Corporation.

Dot Matrix Print Head, co-pending application Ser. No. 470,012, filed Feb. 25, 1983, now U.S. Pat. No. 4,501,506, issued Feb. 26, 1985 invented by David E. Weeks, John W. Reece and Robert L. Wirth, and assigned to NCR Corporation.

Dot Matrix Print Head, co-pending application Ser. No. 470,013, filed Feb. 25, 1983, now U.S. Pat. No. 4,502,799, issued Mar. 5, 1985 invented by David E. Weeks, Robert L. Wirth and John W. Reece, and assigned to NCR Corporation.

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechaical system and which system enables precise control of the impact members.

In the field of dot matrix printers, it has been quite common to provide a print head which has included therein a plurality of print wire actuators or solenoids arranged or grouped in a manner to drive the respective print wires a precise distance from a rest or non-printing position to an impact or printing position. The print wires are generally either secured to or engaged by the solenoid plunger or armature which is caused to be moved such precise distance when the solenoid coil is energized and wherein the plunger normally operates against the action of a return spring.

It has also been quite common to provide an arrangement or grouping of such solenoids in a circular configuration to take advantage of reduced space available in the manner of locating the print wires in that area from the solenoid to the front tip of the print head adjacent the record media. In this respect, the actuating ends of the print wires are spaced in accordance with the circular arrangement and the operating or working ends of the print wires are closely spaced in vertically-aligned manner adjacent the record media. The availability of narrow or compact actuators permits a narrower print head to be used and thereby reduces the width of the printer because of the reduced clearance at the ends of the print line. The print head can also be made shorter because the narrow actuators can be placed in side-by-side manner closer to the recond media for a given amount of wire curvature.

In the wire matrix printer, the print head structure may be a multiple-element type with the wire elements aligned in a vertical line and supported on a print head carriage which is caused to be moved or driven in a horizontal direction for printing in line manner, while the drive elements or transducers may be positioned in a circular configuration with the respective wires leading to the front tip of the print head.

Alternatively, the printer structure may include a plurality of equally-spaced, horizontally-aligned single-element print heads which are caused to be moved in back-and-forth manner to print successive lines or dots in making up the lines of characters. In this latter arrangement, the drive elements or transducers are individually supported along a line of printing. These single wire actuators or solenoids are generally tubular or cylindrically shaped and include a shell which encloses a coil, an armature and a resilient member arranged in manner and form wherein the actuator is operable to cause the print wire to be axially moved a small precise distance in dot matrix printing.

In the concept of dot matrix printing, it is generally desired to place the print element actuators in a position to allow characters to be printed in serial manner and this placement requires that the print wire or like print element actuators be very closely spaced with respect to each other. Since the print actuators are generally much larger in size than the diameter of the printed dot, a relatively long wire or like element must be provided to bring the desired print activity from its source, such as a moving armature or plunger or the like, to a vertical closely-spaced column arranged in a pattern such that the column of closely-spaced, tangentially coincident or overlapping dots will be produced on the record media if all actuators are fired or actuated at one time.

Representative documentation in the field of wire matrix print heads includes U.S. Pat. No. 3,828,908, issued to W. Schneider on Aug. 13, 1974, which discloses a print head having an armature that rests on a coil core and pivots in a groove of the coil yoke. A leaf spring is disposed between the armature and the core and one end of the spring is engaged with a printing needle.

U.S. Pat. No. 3,929,214, issued to D. G. Hebert on Dec. 30, 1975, discloses a wire matrix print head wherein armatures pivot about a fulcrum on the top edge of the outer coil pole, and a unitary connector positions the armatures and provides an O-ring reference surface for the ends thereof.

U.S. Pat. No. 3,994,381, issued to D. G. Hebert on Nov. 30, 1976, discloses an electromagnet assembly wherein the magnetic core and the magnetic yoke are secured to the mounting plate by a single nut. An armature retainer is adjustably attached to the yoke and at the hammer end of such retainer is a backstop or bumper which cushions the return shock of the armature back against the retainer, and spring bias means positions the armature in its non-energized position.

U.S. Pat. No. 4,051,941, issued to D. G. Hebert on Oct. 4, 1977, discloses an electromagnetic structure having a coil with inner and outer pole pieces and an armature along with a retainer for maintaining the armature engaged with the outer pole piece. The retainer is secured to a wire guide assembly and also a resilient member dampens the rebound force of each wire upon deenergization of the coil.

U.S. Pat. No. 4,060,161, issued to C. R. Nelson et al. on Nov. 29, 1977, discloses printing mechanism with armature shims spacing the armatures away from the magnet poles, and a unitary connector with arms for holding ends of the armatures.

U.S. Pat. No. 4,165,940, issued to C. T. Cacciola on Aug. 28, 1979, discloses a dot matrix print head that includes a leaf spring member with fingers for biasing the armatures to pivot on the outer pole.

U.S. Pat. No. 4,185,929, issued to D. G. Hebert on Jan. 29, 1980, discloses armatures biased against the inner pole by an O-ring on a pivot located outwardly from the O-ring.

U.S. Pat. No. 4,204,778, issued to Y. Miyazawa et al. on May 27, 1980, discloses a print head assembly with a spring with arms riveted to the armatures.

U.S. Pat. No. 4,230,038, issued to D. G. Hebert on Oct. 28, 1980, discloses a print head assembly with a plurality of armature members continuously engageable with a first O-ring at an intermediate portion of the members and a second O-ring for continuously engaging a radially outermost portion of the members. The second O-ring serves as a backstop for the armature members in printing operation.

U.S. Pat. No. 4,230,412, issued to D. G. Hebert on Oct. 28, 1980, discloses a print head assembly with a plurality of armature members, each having a drive head portion engaging an impact head portion of the print wire. In one embodiment an O-ring is placed between the drive head portion of the armature member and an adjustment hub member to support the drive head portion, and in another embodiment a flat annular member is used to support the drive head portion.

U.S. Pat. No. 4,244,658, issued to M. Mori on Jan. 13, 1981, discloses a first yoke with a coil frame fitted therein and a second yoke with a flat lever engaging a printing needle and wherein the flat lever is controlled by a suppress member.

U.S. Pat. No. 4,252,499, issued to Y. Miyazawa et al. on Feb. 24, 1981, discloses a printer head wherein the armatures are secured to a contilever spring near the fulcrum of the armatures.

U.S. Pat. No. 4,260,270, issued to P. G. Cavallari on Apr. 7, 1981, discloses a printing head wherein the armatures are placed on the outer magnetic core and biased by resilient string inserted in a groove of the armature retainer.

And, U.S. Pat. No. 4,273,452, issued to H. Honma on June 16, 1981, discloses a print head wherein the armatures are connected to the outer arm of the yoke with a deformation-preventing ring.

SUMMARY OF THE INVENTION

The present invention relates generally to impact printing devices for dot matrix printing wherein at least one print wire or needle is caused to be propelled against a printing medium or like record media by an associated clapper-type, solenoid-actuated, print wire driver for printing dot matrix characters in accordance with external control signals which cause energization of the driver coil and movement of the print wire for enabling printing of the characters. More particularly, the present invention relates to an improved wire matrix print head having a plurality of actuators or drivers positioned for respective print wires and wherein each actuator coil is energized to cause an associated armature or clapper which is engaged with a print wire to propel such print wire or needle a precise distance to mark or print a dot on the record media.

The print wire actuators are arranged in a circular configuration adjacent the print head housing and each of the actuators is associated with the clapper-type armature, in turn engageable with the actuating end of the print wire. The several print wires are arranged to conform with the circular configuration of the print wire actuators at the actuating ends of the print wires and are guided along separate paths to the nose portion of the print head wherein the operating ends of the wires are disposed in a closely-spaced single column so as to effect dot matrix printing.

A unitary member is positioned centrally of the print wire actuators at one end of the print head and is used to position the armatures in relation to the actuators or drivers of the print head. The unitary member is generally cylindrically-shaped to fit in spaces or openings between the inner core poles of the print head actuators and includes a plurality of fingers spaced to locate the armatures in angular relationship in the circular configuration.

Additionally, an end surface of the unitary member is positioned to be engageable by an end plate of the print head and the plurality of fingers are formed to be engageable with an annular portion of the nose of the print head for spacing the parts. The single member thus serves the combined functions of spacing at least two parts of the print head and for providing positioning means for the armatures thereof.

Further, an annular member with resilient portions is provided for retaining the armatures in position relative to the unitary member and in engagement with the inner core pole pieces.

In view of the above discussion, the principal object of the present invention is to provide means for simplifying the assembly of a wire matrix print head.

Another object of the present invention is to provide a single member for positioning several parts of a print head.

An additional object of the present invention is to provide a single member for use in spacing elements of a print head.

A further object of the present invention is to provide a single member, both for spacing parts of the print head in assembled condition and for serving as a positioning means for the print head armatures.

Another object of the present invention is to provide a member with resilient portions for biasing the respective armatures against print wire actuators.

Additional advantages and features of the present invention will become apparent and fully understood from a reading of the following description taken together with the annexed drawing.

BRIEF DESCRIPTION OF THE DRAWING

FIG. 4 is a view taken along the line 4—4 of FIG. 1;

FIG. 12 is an enlarged view, partly in section, of a portion of the print head.

DESCRIPTION OF THE PREFERRED EMBODIMENT

Figure 1:
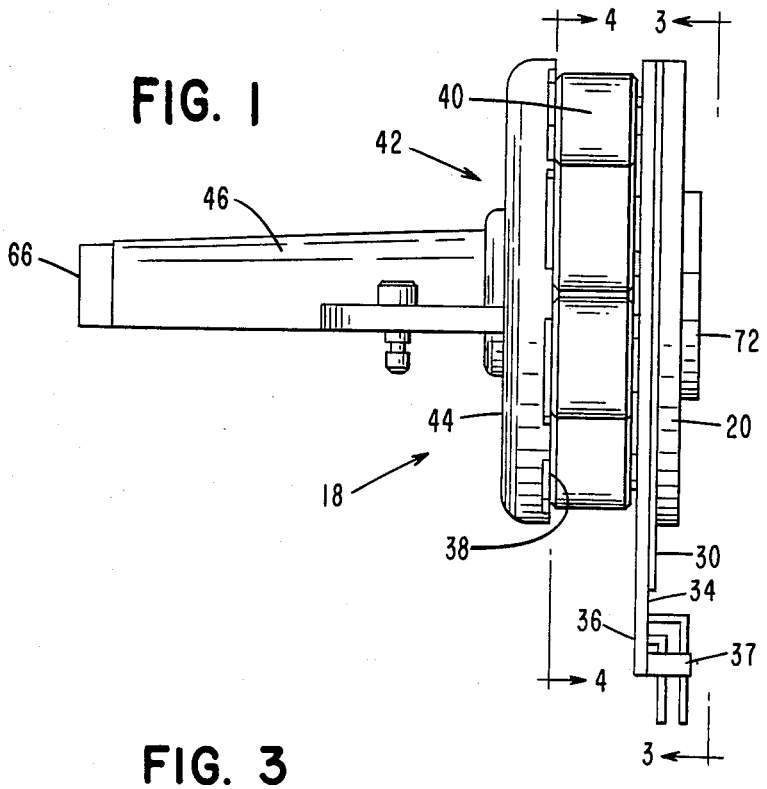
FIG. 1 is a side elevational view of a print head incorporating the subject matter of the present invention.
Figure 2:
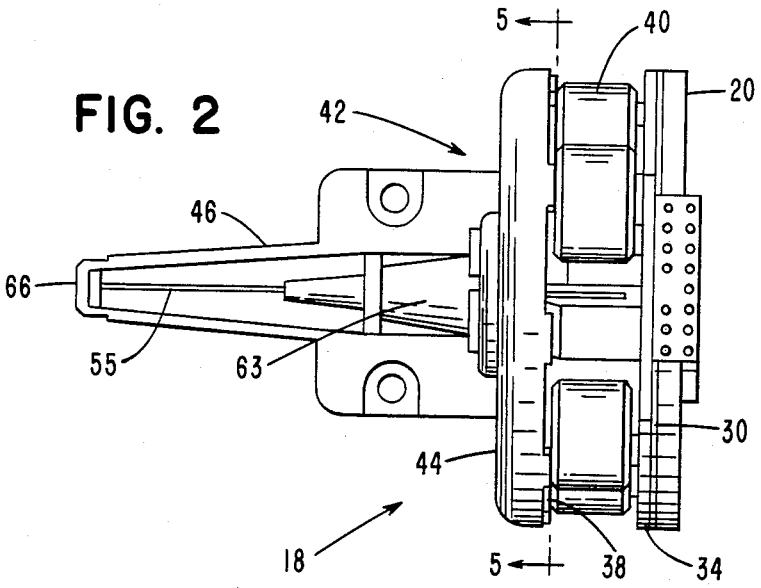
FIG. 2, on the sheet containing

FIG. 1 is a side elevational view and FIG. 2 is a bottom view, which figures illustrate certain parts of a wire matrix-type print head 18 and including an aluminum backplate 20 of circular shape with an aperture 22 (FIG. 3) in the center thereof. A plurality of magnetic core members 23 having outer pole pieces 24 and inner pole pieces 26 (FIGS. 3 and 4) are inserted through respective windows 28 in the backplate 20 and are securely attached so as to be flush with the outer surface of the backplate, with the pole pieces then extending through like windows 28 in an insulating spacer 30 of generally circular shape and made of paper or like material. The core member pole pieces 24 and 26 further extend through windows 32 (FIG. 3) of a printed circuit board 34, also generally circular shaped, but which board includes a lower portion 36 containing socket means 37 for enabling the gathering of and for connecting the individual printed circuits of the circuit board to external wiring. The next element in the arrangement of the print head 18 is a residual spacer 38 (FIGS. 1 and 2) of circular shape and sized of smaller diameter than the above-mentioned parts. The function of the spacer 38 is to minimize the effects of residual magnetism between the pole pieces 24 and 26 and an operating member (later described) actuated by the magnet associated with the core member 23. The printed circuit board 34 both supports and connects a plurality of actuating coils 40 of electromagnets or solenoids in an assembly utilized for actuating the print wires in printing operation. The details of construction of the actuating coils 40 of such electromagnets and the printed circuit board 34 are disclosed in the above-referenced U.S. Pat. No. 4,484,170.

Figure 5:
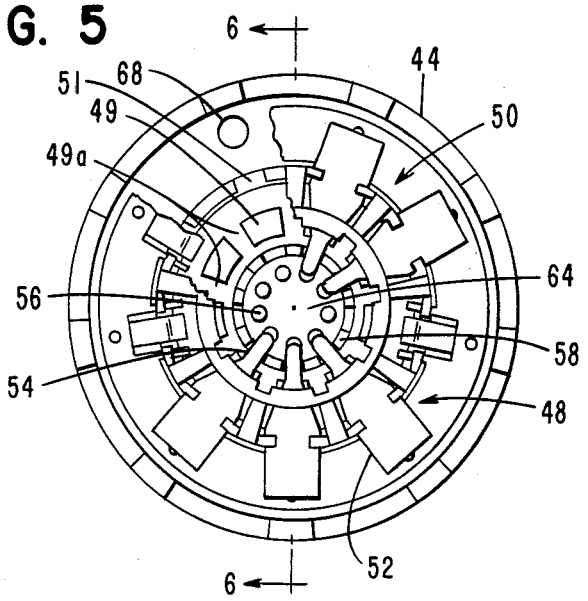
FIG. 5 is a view taken along the line 5—5 of FIG. 2 and including the unitary ring member in position on the nose portion of the print head.
Figure 6:
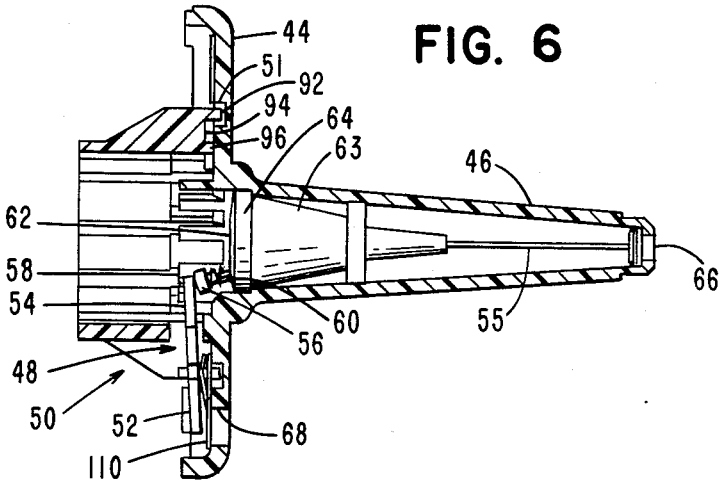
FIG. 6 is a sectional view taken along the line 6—6 of FIG. 5.

Forward of the residual spacer 38 is the print head housing 42 (FIGS. 1 and 2) made of plastic and which generally includes a saucer-shaped flange portion 44 and a nose portion 46 integral therewith (see also FIGS. 5 and 6). The annular flange portion 44 is designed to contain a plurality of print wire engaging members 48 (FIGS. 5 and 6), herein also known as clappers, which are arranged in a circle and radially positioned to be operably associated with the respective actuating coils 40. The clapper members 48 are considered to be the equivalent of armatures for the actuating coils 40 and are somewhat paddle-shaped in appearance and are positioned or located, at least in partial manner, by means of a notched framework portion 49 on the inner surface of the annular flange portion 44. The framework portion 49 (FIG. 5) comprises a nine-sided circular structure defining precisely spaced notches or slots 49*a* formed therein for positioning and locatng or guiding portions of the clapper members 48, through an intermediate member 50, as will be further explained. Each of the clapper members 48 includes a wide portion 52 at the outer end which is the part operably associated with a respective coil 40, and a narrow end portion 54 which engages with a print wire 55 (FIG. 6) and which is guided between and maintained in place by rearwardly extending posts or fingers 58 formed in a circle radially inwardly of the notched framework 49 (FIG. 5). Each print wire has a plastic cap 56 (FIGS. 5 and 6) integrally formed therewith and is biased by a return spring 60 disposed between the plastic cap and an end surface or seat 62 of an inner circular, wire containing portion 64 seated in the nose portion 46 and which spring 60 aids in returning the print wire 55 to the home or non-printing position. The inner portion 64 includes apertures therethrough and is designed as one of the structures to carry and to guide the print wires 55 along their respective paths from the raised surface or seat 62 and across a wire guide bridge, as at 63, and then to a front wire guide tip 66 of the nose portion 46. The details of the construction of the means for carrying and guiding the print wires 55 along such respective paths are disclosed in the above-referenced U.S. Pat. No. 4,501,506.

Further described, FIG. 5 is a view looking toward the nose portion 46 (FIG. 2) and illustrating the arrangement of certain parts in making and in teaching the principles of the present invention. More specifically, FIG. 5 is a view of the housing flange portion 44 looking toward the front of the print head and illustrates a portion of the nine-sided framework 49, as consisting of spaced and raised portions on the inner surface of the flange portion 44 for defining the circular slots 49*a*, and the view also illustrates the circular arrangement of recesses 51 in the flange portion 44, and the rearwardly extending posts or fingers 58 which therebetween contain the narrow-end portions 54 of the clapper or armature members 48. A plurality of apertures 68 (see also FIG. 6) are arranged in a circle around the housing flange portion 44 and correspond with the positions of the wide end portions 52 of the respective clapper members 48 for use in manually checking operation of those members and also the print wires 55 as to freedom of movement thereof.

Figure 3:
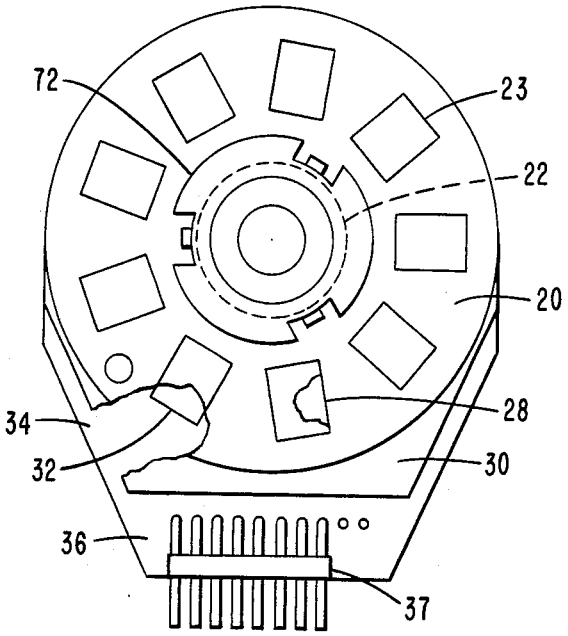
FIG. 3 is a view taken along the line 3—3 of FIG. 1.
Figure 4:
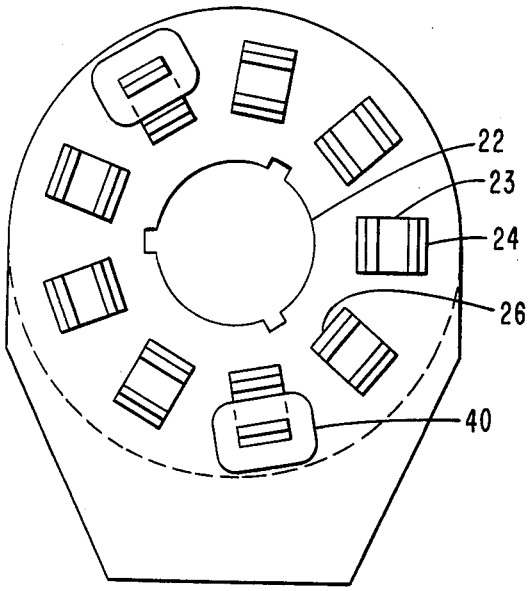
FIG. 4, is a bottom view of the print head shown in FIG. 1.

It is here noted that FIG. 3 also includes an open-end view of a fastener-backstop member, generally described as 72, and which is described in detail in the above-mentioned U.S. Pat. No. 4,502,799. The backplate 20 along with the insulator 30, the printed circuit board 34 and the actuating coils 40 are contained and secured to the housing flange portion 44 (FIG. 1) by the particular contruction of the member 72. As fully described in above-mentioned U.S. Pat. No. 4,502,799, the forward or closed end of member 72 serves as a backstop for the clapper members 48 when they are returned from the printing to the home or non-printing position. A raised central portion of the forward end portion of such member 72 provides a seat for the narrow end portions 54 of the clapper members 48 by engagement with one side thereof. The opposite side of each of the narrow end portions 54 of the clapper members 48 engages with the plastic cap 56 (FIG. 6) of the associated print wire 55 and is biased thereagainst by the action of the spring 60 between the spring seat 62 and the plastic cap.

When the actuating coil 40 is energized, the wide end portion 52 (FIG. 5) of the associated clapper member 48 is caused to be pulled in a manner whereby the armature or clapper member is pivoted or rocked in a clockwise direction (FIG. 6) and the narrow end portion 54 of such clapper member is moved against the cap 56 to cause the print wire 55 to be moved toward the front end 66 of the print head housing 42 and to a printing position. Upon deenergizing the coil 40, the clapper 48 is rocked in a counterclockwise direction by action of the return spring 60 against the cap 56 and such narrow end portion 54 of the clapper member 48 is returned to rest for seating on the central portion of the fastener-backstop member 72.

Figure 7A:
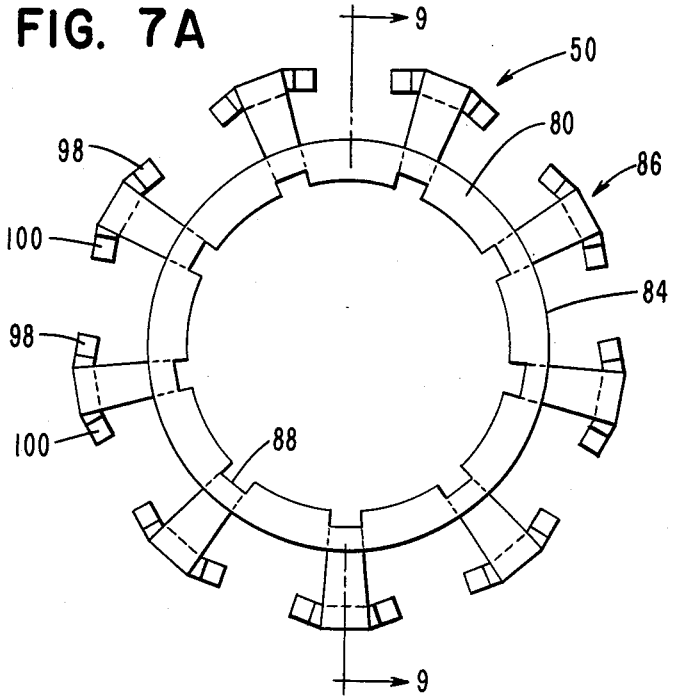
FIG. 7A is an enlarged-scale end view of the unitary ring member.
Figure 8:
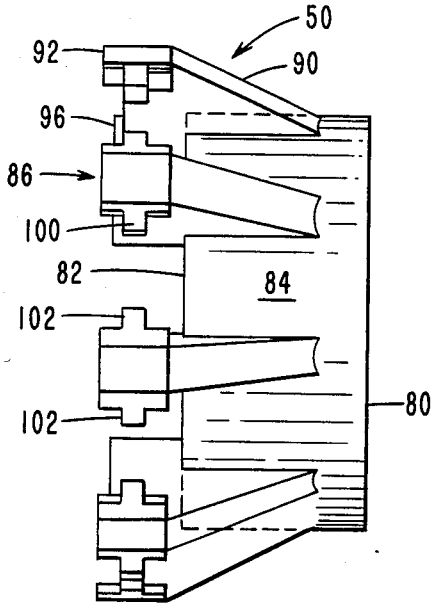
FIG. 8 is a side view of the unitary ring member.
Figure 9:
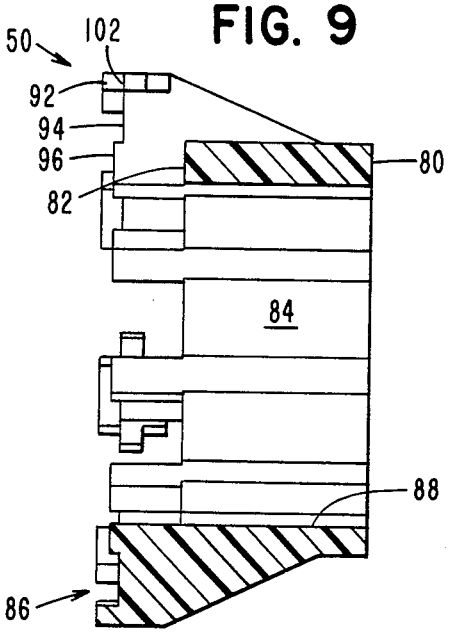
FIG. 9 is a sectional view taken along the line 9—9 of FIG. 7.

Associated with the notched framework 49 mentioned above is a single or unitary ring member 50, made of glass-filled platic and of irregular shape, shown in place with the annular flange portion 44 in FIGS. 5 and 6, and illustrated in detail in FIGS. 7, 8 and 9, which unitary ring member performs two functions in the print head 18. The ring member 50 positions the electromagnetic actuator portion of the print head 18 with respect to the print wire guide portion. In this respect the unitary ring member 50 provides support and locates the clappers or armatures 48 in proper relationship with the electromagnetic cores 23. A second function of the unitary ring member 50 is to position and locate the electromagnetic actuator subassembly consisting of the clappers 48, the core members 23 back-plate 20, and the coils 40 circuit board 34 in spaced relationship with respect to the front housing subassembly consisting of the print wires 55, the guide and support housing 46, along with the wire guide bridge 63, the wire guide tip 66, and the flange portion 44. The actuator subassembly and the front housing subassembly are secured together with the fastener-backstop member 72.

FIGS. 5 and 6 show the ring member 50 positioned in an operating relationship with the annular flange portion 44 of the front housing subassembly of the print wire containing and guide portion of the print head 18. As clearly illustrated in FIGS. 7A, 7B, 8 and 9, one end of the ring member 50 is formed with a straight or flat ring surface 80 and the other end of the ring member is formed with a like ring surface 82, such surfaces being parallel and defining a hub portion 84 therebetween. A plurality of slanted projections 86 are formed integral with and extend outwardly from the hub portion 84 in a crownlike arrangement. Such hub portion 84 also includes a plurality of recesses 88 in the inside diameter thereof facing and corresponding with the projections 86. The effect of the recesses 88 running the length of the hub portion 84 provides a reduced wall thickness at selected locations in the hub portion.

Figure 7B:
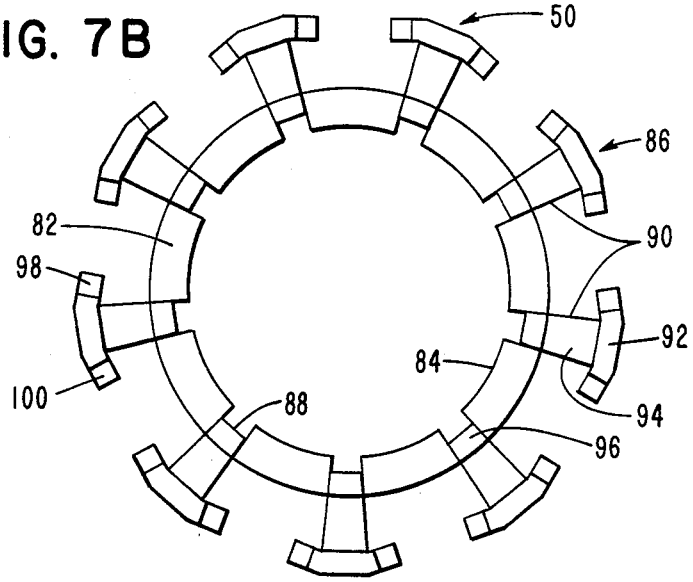
FIG. 7B, on the sheet containing

FIG. 7A illustrates an end view of the unitary ring member 50 looking in the direction of the nose portion 46 (FIGS. 1, 2 and 6) or from right to left in FIG. 8, and FIG. 7B is an end view of the ring member looking from left to right in FIG. 8. Each slanted projection 86 includes an inclined triangular-shaped portion 90 (FIG. 8) starting at a point about midway on the hub portion 84 and extending beyond the ring surface 82 to provide a flat rectangular-shaped extremity 92 (FIG. 7B). A flat rectangular-shaped surface 94 is formed between the extremity 92 and a smaller, flat rectangular-shaped extremity 96 terminating short of the extremity 92 (FIGS. 8 and 9). A pair of ears 98 and 100 (FIGS. 7A and 7B) are formed on each projection 86 in a circle and at a radius corresponding with the extremity 92 and positioned such that one surface 102 of each ear is on the same plane as the surface 94. The open space between ear 98 of one projection 86 and ear 100 of the adjacent projection provides clearance for the reduced portion of armature member 48 for positioning the member (FIG. 5) in the assembly of the print head. The extremity 92 extends into the recess 51 of the flange portion 44 (FIG. 6) and the extremity 96 seats in the slot **49*a* formed in the framework portion 49 of the flange portion 44. In effect, the extremities 96 provide the surface contact of the ring member 50 with the flange portion 44**.

Figure 10:
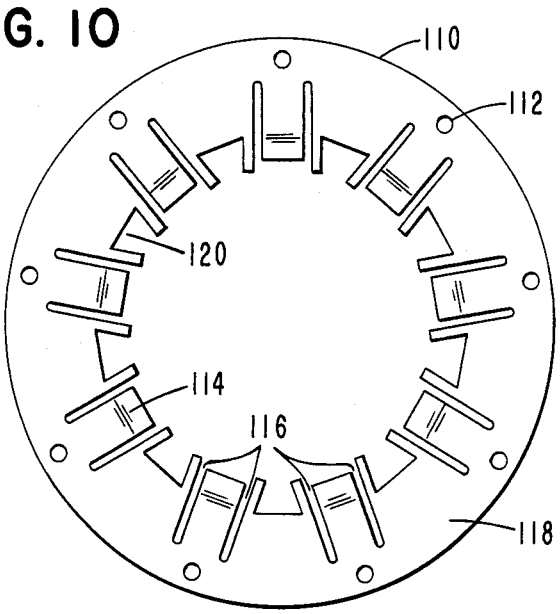
FIG. 10 is a view of a unitary resilient member associated with the ring member.
Figure 11:
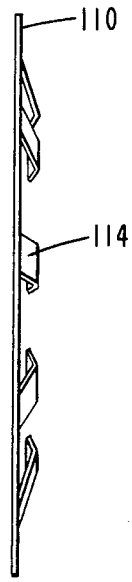
FIG. 11 is a side view of the unitary resilient member.

FIGS. 10 and 11 illustrate a unitary spring member 110 positioned adjacent and in contact with the annular flange 44, as seen in FIG. 6, and including resilient portions for biasing each of the clappers 48 against the residual spacer 38 and a corner of the inner pole piece 26 of the respective core member 23 for retaining the clappers in a preferred position, which is in engagement with the core member inner pole pieces. The spring member 110 includes a plurality of apertures 112 therein corresponding to the apertures 68 in the annular flange 44 for access in checking operation of the armatures 48. Aligned radially inwardly with each of the apertures 112 is a resilient leaf or spring finger portion 114 formed outwardly (FIG. 11) and defined by a pair of kerfs 116 at spaced points cut into the flat portion 118 of the spring 110. Such spring finger portions, as seen in FIG. 6, provide the previously described bias to the respective clappers 48. A plurality of recesses 120 are formed between the spring fingers 114 to fit around the outer extremities 92 (FIGS. 8 and 9) of the ring member 50.

Figure 12:
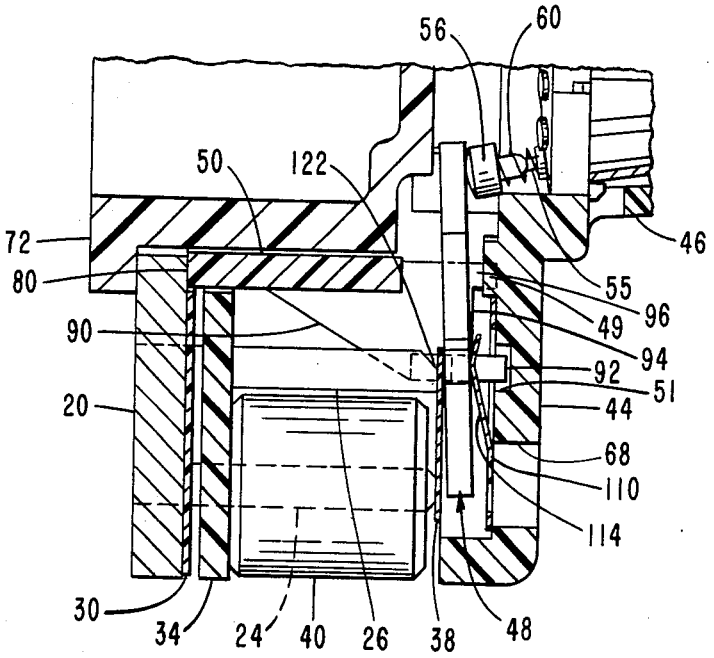
FIG. 12, is an end view opposite that of FIG. 7A of the unitary ring member.

FIG. 12 is an enlarged view, partly in section, of a portion of the print head showing the backplate 20, the core poles 24 and 26, the insulator 30 and the circuit board 34 with the coils 40. The ring member 50 spaces the back plate 20 and the flange member 44 by contact of surface 80 of the ring member with plate 20 and by contact of extremity 96 of the ring member with flange member 44 at the respective slot **49*a* in the notched framework 49. The clapper or armature 48 is actuated by the coil 40 to move the print wire cap 56 and the print wire 55 against the action of spring 60. The retainer spring member 110 has the finger portion 114 biasing the clapper or armature 48 against a corner 122 of the core member 23 inner pole piece 26. The ring member 50 spaces the rer subassembly and the front subassembly, and the fastener 72 holds the backplate 20 and the flange member 44**, along with the several parts therebetween, in secure and assembled manner.

In the assembly of the print head 18, the ring member 50 functions as a spacer between the front and rear subassemblies. The backplate 20 with core members 23 secured thereto, along with the insulator 30, the printed circuit board 34 and the actuating coils 40 make up the rear subassembly. The sequence of assembly of parts to the rear subassembly includes placing the residual spacer 38 on the core members 23 and the ring member 50 is then inserted into position wherein the flat ring surface 80 thereof engages with the front surface of the backplate 20 adjacent the aperture 22. The clappers 48 are then placed on ring member 50 so that projections 98 and 100 thereof engage the notches in the clappers which positions the clappers properly with respect to the actuating coils 40 and the pole pieces 24 and 26. The spring member 110 is then placed over ring member 50 with the projections 92 thereof engaging the openings or recesses 120 for properly locating the member 110. The front subassembly is then placed on the rear subassembly which places the posts 58 between the narrow end portions 54 of the clappers 48 and engages the clappers with the print wire caps 56 and slightly compresses the spring member 110.

The front subassembly generally comprises the annular flange portion 44 and the nose portion 46 which contains the print wires 55. When the front or nose portion subassembly is placed into position with the rear or backplate subassembly, the flat rectangular-shaped extremities 96 of the ring member 50 engage the surfaces of the annular flange portion 44 around the radius and between the raised portions, i.e., within the slots **49*a*, formed by the notched framework 49, and the extremities 92 of such ring member 50 fit into the recesses 51 formed in a circle radially outwardly of the notched framework 49 of the flange portion 44. In this manner the ring member 50 spaces the two subassemblies so that the nose portion can be easily placed into position whereby the legs of the fastener member 72 can then be inserted along the recesses 88 in ring member 50 and through apertures in the flange portion 44 to secure the print head 18**.

It is thus seen that herein shown and described is a unitary ring member that serves the combined functions of spacing the several subassemblies of the print head and of providing a positioning structure for the print wire armatures. The apparatus of the present invention enables the accomplishment of the objects and advantages mentioned above, and while a preferred embodiment has been disclosed herein, variations thereof may occur to those skilled in the art. It is contemplated that all such variations not departing from the spirit and scope of the invention hereof are to be construed in accordance ith the following claims.

We claim:

1. In a wire matrix print head including a mounting plate having a plurality of electromagnets supported therefrom in a circular arrangement, an annular member and a nose portion integral therewith for housing a plurality of wires, and a plurality of armatures operably associated with the electromagnets and pivotable thereby for driving the wires from a non-printing to a printing position, the improvement comprising a unitary member positioned centrally of said electromagnets and having projecting portions at one end of the unitary member formed to fit each of the armatures at a reduced portion thereof for positioning each of the armatures in relation to a respective electromagnet and having end portions engageable with the mounting plate and with the annular member for spacing the mounting plate and the annular member in fixed relationship one from the other, and means having individual resilient portions for retaining each of the armatures in position relative to said unitary member and for biasing each of the armatures against its respective electromagnet.

2. In the wire matrix print head of claim 1 wherein the unitary member includes projecting portions formed for alignment of the unitary member by the electromagnets.

3. In the wire matrix print head of claim 1 wherein the unitary member includes projecting portions formed on the periphery thereof for centrally aligning the unitary member with the electromagnets.

4. In the wire matrix print head of claim 1 wherein the retaining and biasing means is a single member having portions formed for aligning with the unitary member.

5. In the wire matrix print head of claim 1 wherein the armatures define slots therein and the projecting portions of the unitary member are formed to fit in said slots for positioning the armatures.

6. In the wire matrix print head of claim 1 wherein the unitary member includes a ring portion at one end thereof for engaging with the mounting plate and a plurality of projecting portions at the other end thereof for engaging with the annular member.

7. A wire matrix print head comprising a mounting plate having a plurality of electromagnets supported therefrom in a circular arrangement, an annular member and a nose portion integral therewith for housing a plurality of print wires, a plurality of armatures operably associated with the electromagnets and pivotable thereby for driving the wires from a non-printing to a printing position, a unitary member of generally cylindrical shape positioned centrally of said electromagnets and having projecting portions at one end of the unitary member formed to fit each of the armatures at a reduced portion thereof for positioning each of the armatures in relation to a respective electromagnet and having edge portions engageable with the mounting plate and with the annular member for spacing the mounting plate and the annular member a fixed distance one from the other, and means having individual resilient portions for retaining each of the armatures in position relative to the unitary member and for biasing each of the armatures against its respective electromagnet.

8. The wire matrix print head of claim 7 wherein the unitary member includes spaced projecting portions formed for alignment of the unitary member by the electromagnets.

9. The wire matrix print head of claim 7 wherein the unitary member includes spaced projecting portions formed on the periphery thereof for centrally aligning the unitary member with the electromagnets.

10. The wire matrix print head of claim 7 wherein the retaining and biasing means is a single resilient member having spaced portions formed therefrom for aligning with the unitary member.

11. The wire matrix print head of claim 7 wherein the armatures define slots in the sides thereof and the projecting portions of the unitary member are formed to fit in said slots for positioning the armatures.

12. The wire matrix print head of claim 7 wherein the unitary member includes a ring-shaped portion at one end thereof for engaging with one surface of the mounting plate and a plurality of spaced projecting portions at the other end of the unitary member for engaging with the annular member at a plurality of surfaces thereof.

13. A wire matrix print head comprising a mounting plate having a plurality of electromagnets supported therefrom in a circular arrangement, an annular member and a nose portion integral therewith for housing a plurality of print wires, a plurality of armatures operably associated with the electromagnets and pivotable thereby for driving the wires from a non-printing to a printing position, a unitary member aligned centrally of the electromagnets and having spaced projecting portions at one end of the unitary member formed to fit each of the armatures at a reduced width portion thereof for positioning each of the armatures in relation to a respective electromagnet and having end portions engageable with the mounting plate and with the annular member and spacing the mounting plate and the annular member a fixed distance from each other, and resilient means engageable with the armatures and having individual portions for biasing each of the armatures against its respective electromagnet.

14. The wire matrix print head of claim 13 wherein the unitary member includes a plurality of projecting portions spaced for positioning the armatures with respective electromagnets.

15. The wire matrix print head of claim 13 wherein the armatures define slots oppositely disposed in the sides thereof and the spaced projecting portions of the unitary member are formed to fit in said slots for positioning the armatures.

16. The wire matrix print head of claim 13 wherein the unitary member includes a ring-shaped portion at one end thereof for engaging with a cooperating surface of the mounting plate and a plurality of projecting portions at the other end thereof and formed in a ring larger than the ring-shaped portion and engageable with the annular member at a plurality of cooperating surfaces thereof.

17. In a wire matrix print head having a housing with an elongated portion and an annular portion, a plurality of print wires extending from the annular portion and through the elongated portion to the end thereof, means including a plurality of armatures pivotable for actuating the print wires from a non-printing to a printing position, and a mounting plate adjacent one end of the actuating means for supporting the actuating means in position for operating the print wires, the improvement comprising a unitary member having end portion surfaces engageable with the mounting plate and with the annular portion and spacing the mounting plate and the annular portion in fixed relationship from each other and having projecting portions at one end of the unitary member formed to fit each of the armatures at a reduced width portion thereof for positioning each of the armatures in relation to its respective actuating means, and resilient means having individual portions engageable with the armatures for retaining thereof relative to the unitary member and for biasing each of the armatures against the actuating means.

18. In the wire matrix print head of claim 17 wherein the unitary member includes a plurality of projecting portions formed for alignment of the unitary member by the actuating means.

19. In the wire matrix print head of claim 17 wherein the armatures define a pair of slots oppositely disposed in the sides thereof and the projecting portions of the unitary member are formed to mate with the slots for positioning the armatures.

20. In the wire matrix print head of claim 17 wherein the resilient means is a single member having spaced portions formed for aligning with the unitary member.

* * * * *